United States Patent [19]

Whiteman, Jr.

[11] 4,316,067

[45] Feb. 16, 1982

[54] SLIDE SWITCH

[75] Inventor: Robert N. Whiteman, Jr., Middletown, Pa.

[73] Assignee: AMP Incorporated, Harrisburg, Pa.

[21] Appl. No.: 135,815

[22] Filed: Mar. 31, 1980

[51] Int. Cl.[3] ..... H01H 9/00; H01H 15/00

[52] U.S. Cl. ..... 200/291; 200/16 R; 200/16 D; 200/292; 200/260

[58] Field of Search ..... 200/16 R, 16 A, 16 B, 200/16 D, 291, 292, 252, 260, 303, 255, 257, 164 R, 164 A, 293

[56] References Cited

U.S. PATENT DOCUMENTS

| | | | |
|---|---|---|---|
| Re. 26,636 | 7/1969 | Hults . | |
| 3,209,088 | 9/1965 | Wanlass et al. | |
| 3,311,719 | 3/1967 | Vananzi . | |
| 3,485,966 | 12/1969 | Bailey et al. | 200/16 D |
| 3,829,634 | 8/1974 | Levasseuv | 200/16 R |
| 3,888,807 | 6/1975 | Lockard | 200/16 R |
| 3,947,391 | 3/1976 | Lutzenberger | 200/291 |
| 4,016,378 | 4/1977 | Arthur | 200/291 |
| 4,029,914 | 6/1977 | Schmidt et al. | 200/292 |
| 4,057,520 | 11/1977 | Schwartz | 200/16 D |
| 4,075,442 | 2/1978 | Fukada et al. | 200/16 R |
| 4,139,746 | 2/1979 | Farrell et al. | 200/16 D |
| 4,152,565 | 5/1979 | Rose | 200/291 |
| 4,186,288 | 1/1980 | Overton et al. | 200/16 D |

FOREIGN PATENT DOCUMENTS

| | | |
|---|---|---|
| 52-66963 | 6/1977 | Japan . |
| 53-11071 | 1/1978 | Japan . |

*Primary Examiner*—John W. Shepperd
*Attorney, Agent, or Firm*—Frederick W. Raring

[57] ABSTRACT

A slide switch intended for mounting on a circuit board to switch terminal pads on the board comprises a channel-shaped sheet metal switch housing, an insulating slide member captured between the sidewalls of the housing, and switch contact members mounted on the outwardly facing surface of the slide member. When the switch is mounted on the circuit board, the switch contact members contact the terminal pads on the circuit board. Retaining means and detent means for the slide member are formed from the sidewalls of the sheet metal housing. Switches can be produced in strip form with the switch housings integral with, and extending laterally from, a continuous carrier strip.

11 Claims, 12 Drawing Figures

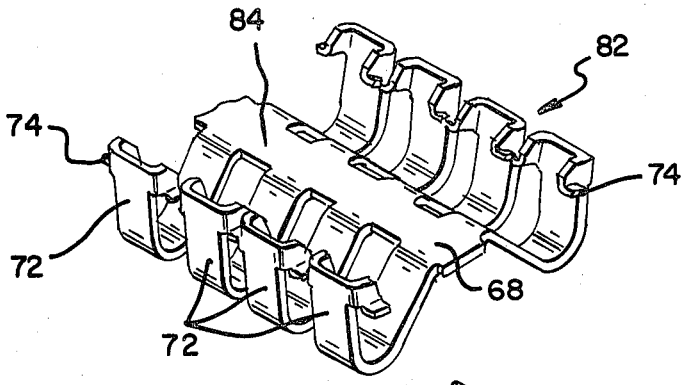
Fig. 6
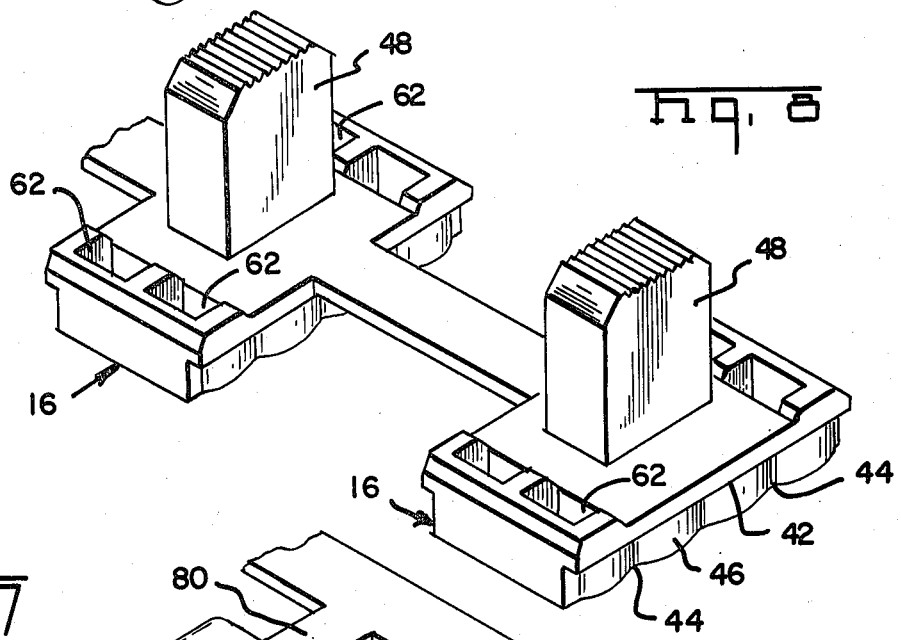
Fig. 8
Fig. 7
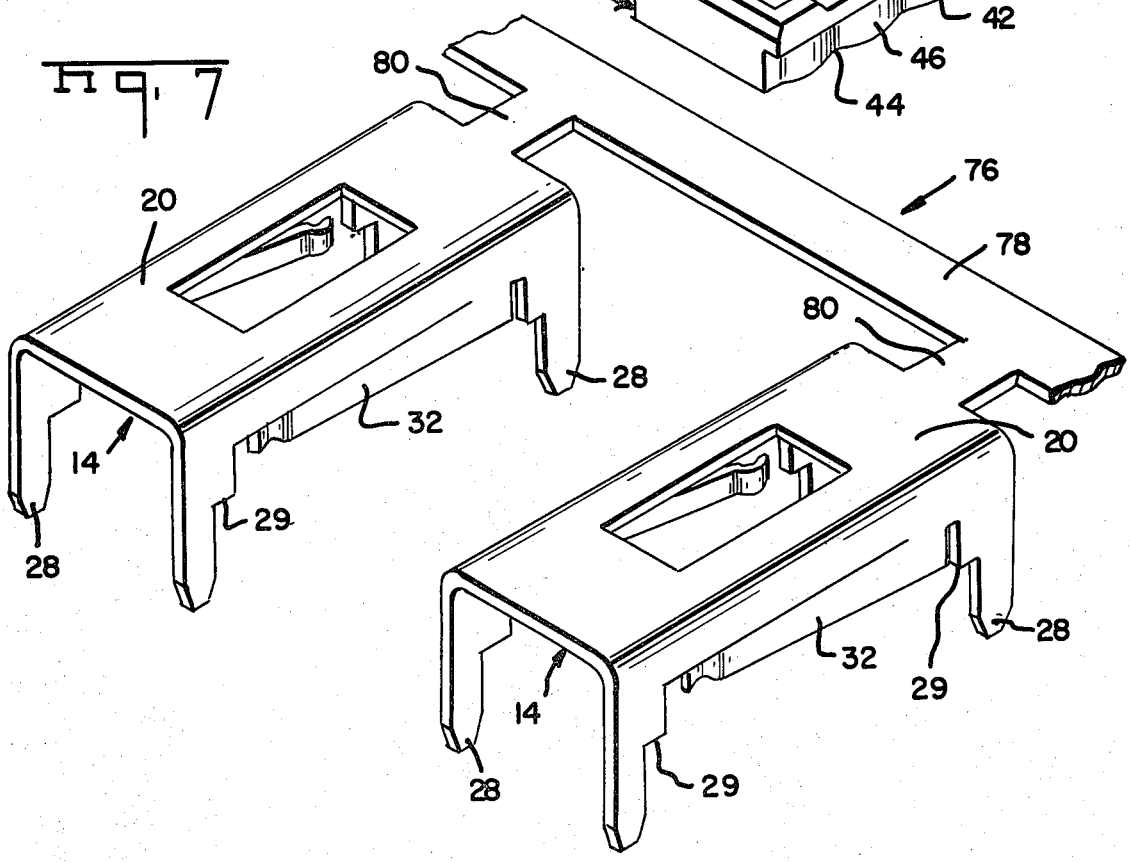

SLIDE SWITCH

FIELD OF THE INVENTION

This invention relates to slide switches of the type which are mounted on circuit boards for switching circuit board conductors.

BACKGROUND OF THE INVENTION

A widely used type of slide switch comprises a housing containing a slide member having the movable switch contacts thereon and having the fixed contacts contained within the housing. Conductive mounting posts extend from the housing and are soldered to conductors which are to be switched on the circuit board. While switches of this general type are capable of satisfactory performance they are relatively complex and constitute, in many cases, an inordinately expensive component of the devices in which they are used. Moreover, circuit board slide switches are customarily produced as loose piece items and are assembled to circuit boards either manually or by means of relatively complex assembly equipment.

The present invention is directed to the achievement of an improved slide switch intended for circuit board use having a substantially reduced number of component parts, and having contacts thereon which are directly engageable with terminal pads on the circuit board. Assembly of the switch to the circuit board does not require soldering, but rather can be achieved by mechanical clinching of mounting feet integral with the switch housing. The invention is further directed to the achievement of a slide switch which can be produced in strip form, that is, with each switch integral with a continuous carrier strip so that individual switches can be assembled to the circuit boards by automatic assembly machines.

A preferred form of switch in accordance with the invention comprises a generally channel-shaped sheet metal switch housing and a slide member captured between the internal sidewalls of the housing. The slide member is retained in the housing by means of detent spring arms struck from the housing sidewalls and extending inwardly past shoulder surfaces on the sides of the slide member. The detent spring arms have free ends which are received in spaced-apart recesses in the sides of the slide member to provide a detent effect for the slide relative to the housing. The housings are produced as a continuous strip comprising a carrier strip having the housings extending laterally therefrom at spaced-apart intervals. The slide members and contact members, which are mounted on the outwardly facing surface of each slide member, can be assembled automatically to the housings as the housing strip is fed through assembling machines. The finished strip of assembled switches can then be fed to an assembly machine and the switches individually severed from the strip and assembled to circuit boards.

DRAWINGS

FIG. 1 is a perspective view of a slide switch in accordance with the invention exploded from the surface of a circuit board.

FIG. 2 is a perspective view of the switch with the parts thereof exploded from each other.

FIGS. 3 and 4 are sectional views of the switch taken along the lines 3—3 and 4–4 of FIG. 1.

FIG. 5 is a sectional side view of the switch mounted on a circuit board.

FIG. 6 is a perspective view of a strip of contact members used in the switch.

FIG. 7 is a perspective view of a strip of switch housings.

FIG. 8 is a perspective view of a strip of slide members.

FIG. 9 is a perspective view of a continuous strip of slide switches.

FIG. 10 is a view similar to FIG. 3 taken along the lines 10—10 of FIG. 11 of an alternative embodiment.

FIG. 11 is a plan view of the underside of the switch of FIG. 10.

FIG. 12 is a fragmentary perspective view illustrating the manner of securing the contact members to the slide member of the embodiment of FIG. 10.

DESCRIPTION OF THE DRAWINGS

Referring first to FIGS. 1 and 2, a switch 2, in accordance to one embodiment of the invention, is intended for assembly at the upper surface 4 of a circuit board 6 having three associated pairs of terminal pads thereon 8, 8', 10, 10', and 12, 12'. The terminal pads 8, 8' are elongated relative to the other terminal pads and the function of the switch is to switch the pads 12, 12', or 10, 10' to connect them to the elongated pads 8, 8'.

The assembled switch 2 comprises a housing 14, a slide member 16, and switch contact members 18, as shown in FIG. 2. The housing comprises a stamped and formed sheet metal channel-shaped member having a web 20 and sidewalls 26 extending from the side edges of the web and extending between the ends 22, 24 of the housing. Mounting feet 28 extend downwardly, as viewed in FIG. 1, beyond the edges 29 of the sidewalls and are dimensioned to be received in holes 30 in the circuit board 6 so that the switch can be assembled to the circuit board in covering relationship to the terminal pads by simply moving the switch downwardly from the position shown in FIG. 1 and clinching the feet 28 against the underside of the circuit board 6.

Figure 1:
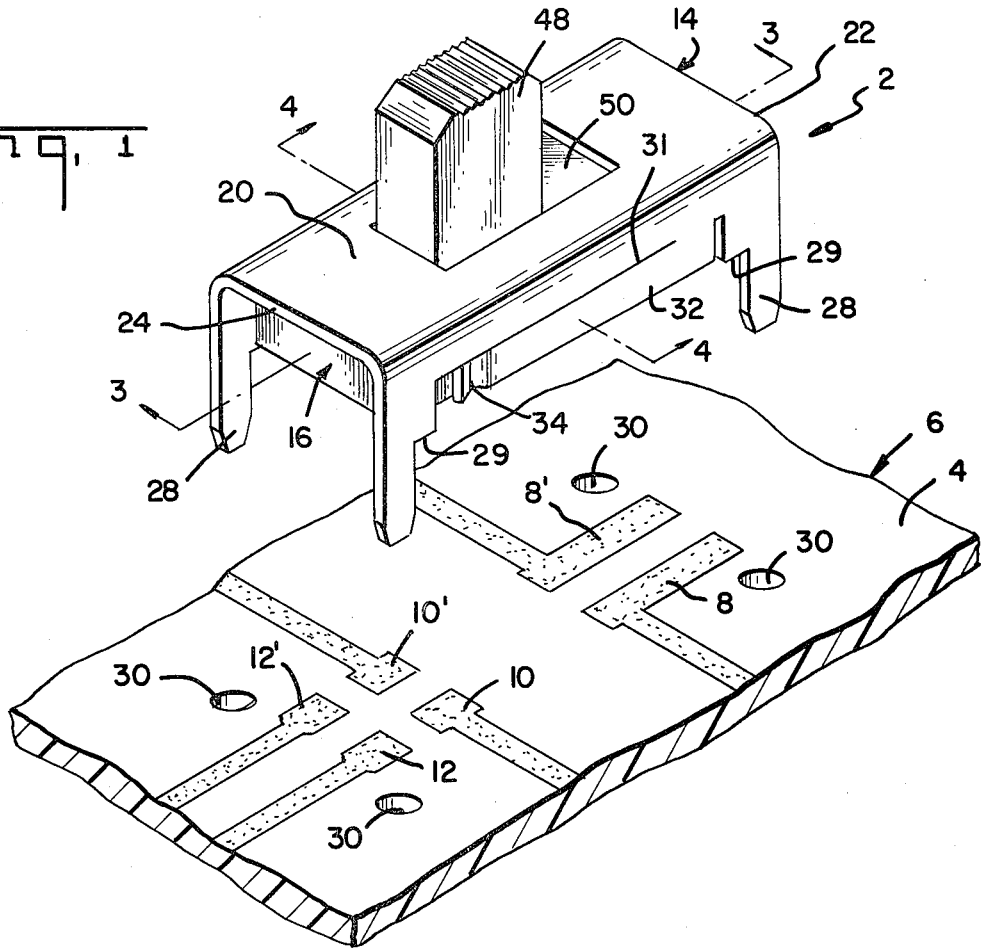
Figure 4:
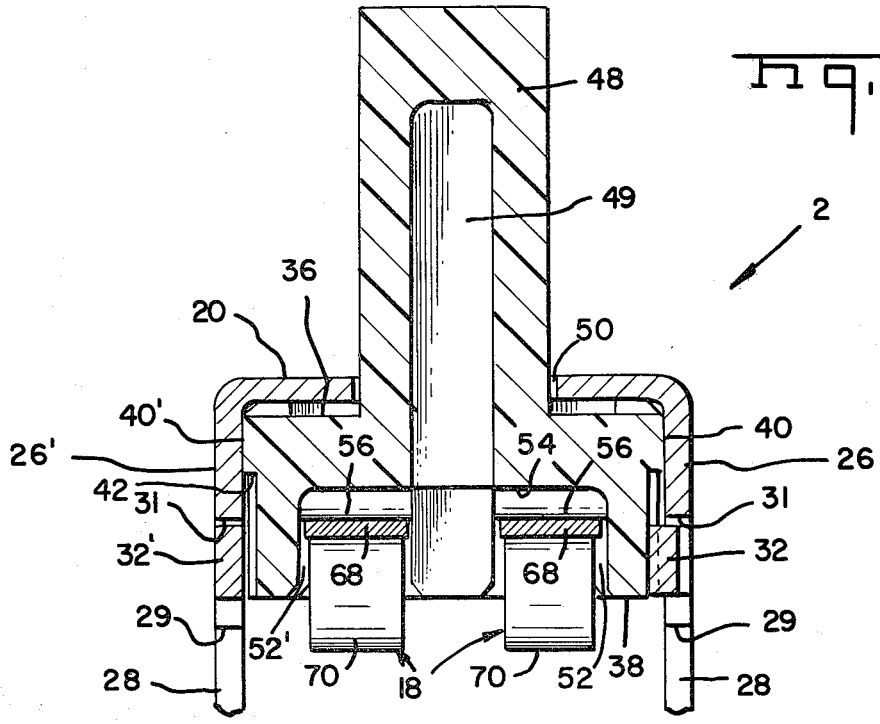

Spring arm members 32, 32' are formed from the sidewalls 28, 28' by severing the sidewalls, as shown at 31, along severing lines which extend parallel to the axis of the housing. The severing can be carried out by shearing along the lines 31 or by punching out a narrow band of material along these lines. In either event, the arms 32 should be formed such that they are free to flex and the upper edges of these arms should not engage the edges of the sidewall. The arms extend obliquely inwardly beyond the sidewalls and have arcuately formed free ends 34 which cooperate with detent recesses 44 in the slide member 16, as described below. It will be noted, that the arm 32 has its fixed end adjacent to the end 22 of the housing while the arm 32' has its fixed end adjacent to the end 24. This arrangement provides support for the slide member 16 adjacent to each of its ends, as will become apparent from the description presented below.

The slide member 16 comprises a block of suitable insulating material, such as a 6/6 nylon material having upwardly and downwardly, as viewed in the drawing, major surfaces 36, 38, side surfaces 40, 40' and ends 41. The width of the slide member, as measured between the sides 40, 40' is slightly less than the distance between the internal surfaces of the housing sidewalls 26, 26' and the length of the slide member is somewhat less than the length of the housing. The sides 40, 40' have downwardly facing shoulder surfaces 42 extending between the ends 41 and spaced apart recesses 44 are provided at predetermined equally spaced intervals along the lower portions of the side surfaces and between the shoulder surfaces 42 and the downwardly facing major surface 38. These spaced-apart recesses 44 are formed by providing a scalloped surface on the sides so that adjacent recesses 44 are separated by arcuate surface portions 46.

An integral projection 48 extends upwardly from the surface 36 of the slide member and in the assembled switch this projection extends through a rectangular hole 50 in the web 20 of the housing. This projection 48 can serve as a fingerpiece for changing the condition of the switch, or can be engaged by a mechanism, such as a lever, for changing the condition of the switch. As shown in the cross-sectional view, this fingerpiece is hollow, in accordance with good molding practice, and an opening extends upwardly through and into the surface 38 and into the projection.

The slide member 16 is assembed to the housing 14 by simply flexing the arms 32, 32' outwardly, moving the slide member into assembled relationship with the housing, as shown in FIG. 1, and then permitting the arms 32, 32' to return to their normal positions. The arms will then be resiliently biased against the scalloped side surfaces of the slide member and the upper edge of each arm will extend past and across the associated downwardly facing shoulder surfaces 42 of the slide member to retain it in its assembled relationship with the housing. When the slide member is moved by means of the projection 48, the ends of the spring arms 32, 32' are cammed outwardly by the arcuate surfaces 46 and with the ends of these arms enter one of the recesses 44, it is apparent that the switch is in one of its detent positions.

Figure 2:
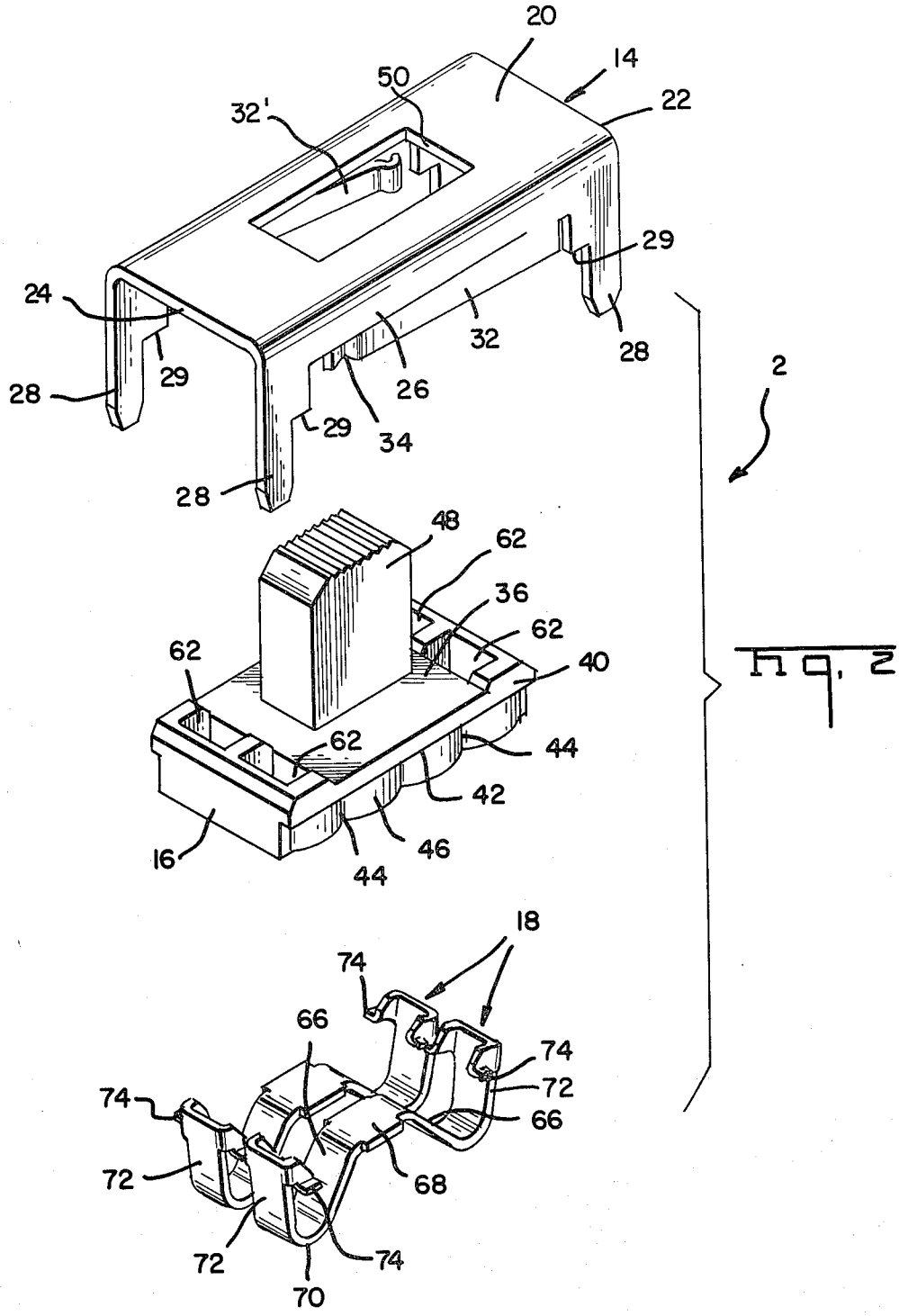
Figure 1:
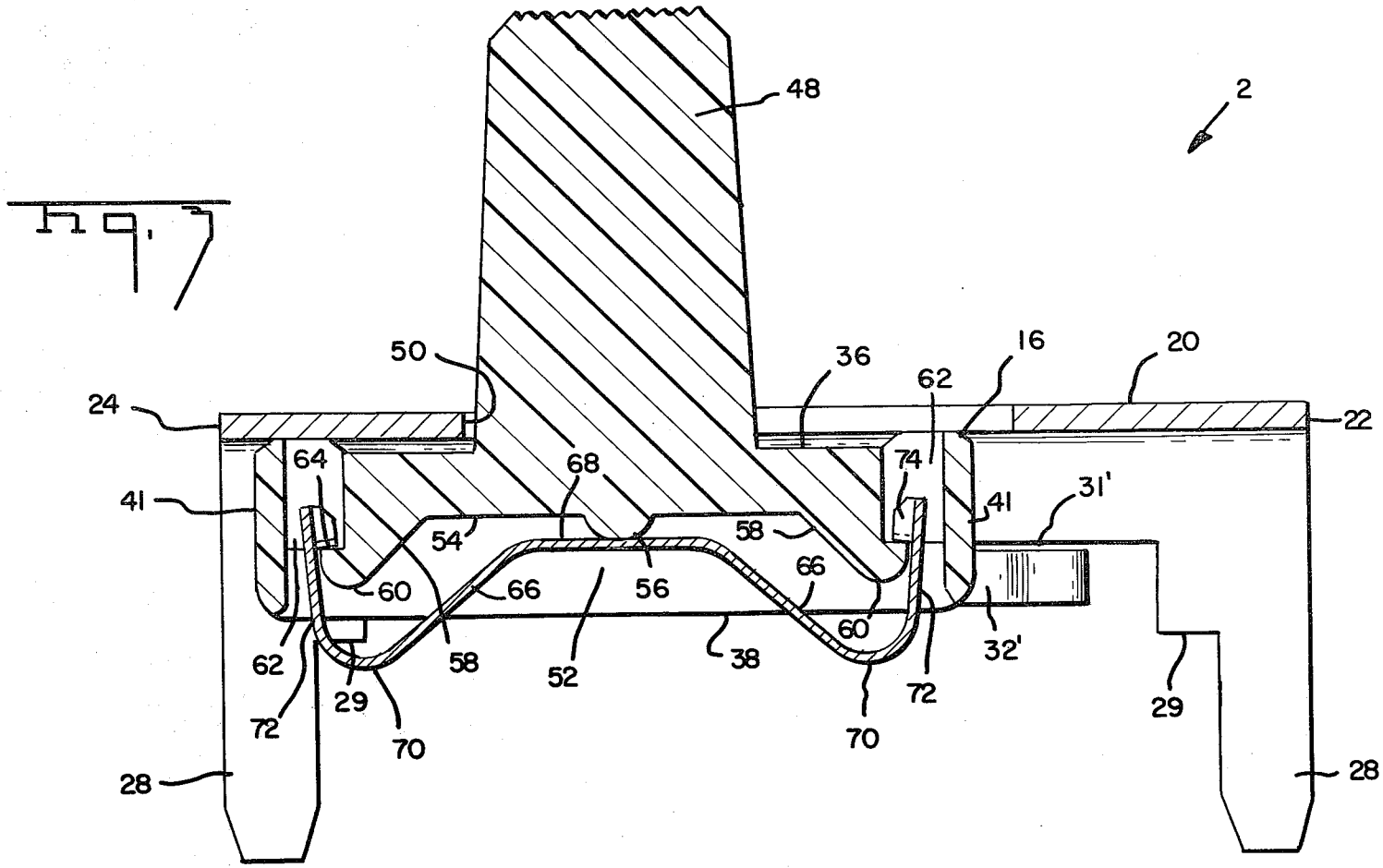

The switch embodiment shown in FIGS. 1 and 2 has two contact members therein, each of which is received in one of two identical cavities 52, 52'. Cavity 52 extends between the ends 41 of the slide member and has an inner surface 54 which is recessed from the surface 38. A centrally located arcuate boss 56 is provided on the cavity inner surface 54 which serves as a reaction surface for the contact member 18 which is received in the cavity. The surface 54 merges, adjacent to each end of the housing, with an outwardly inclined surface 58 which extends towards the plane of the major surface 38 of the block or slide. The inclined surface 58, in turn, merges with a reversely extending arcuate surface 60 which extends to an opening 62. Each opening 62 extends through the slide member from the lower major surface 38 to the upper major surface 36 thereof and an upwardly facing shoulder 64 is provided in each opening 62 for cooperation with retaining means on the switch contact member as described below.

Figure 5:
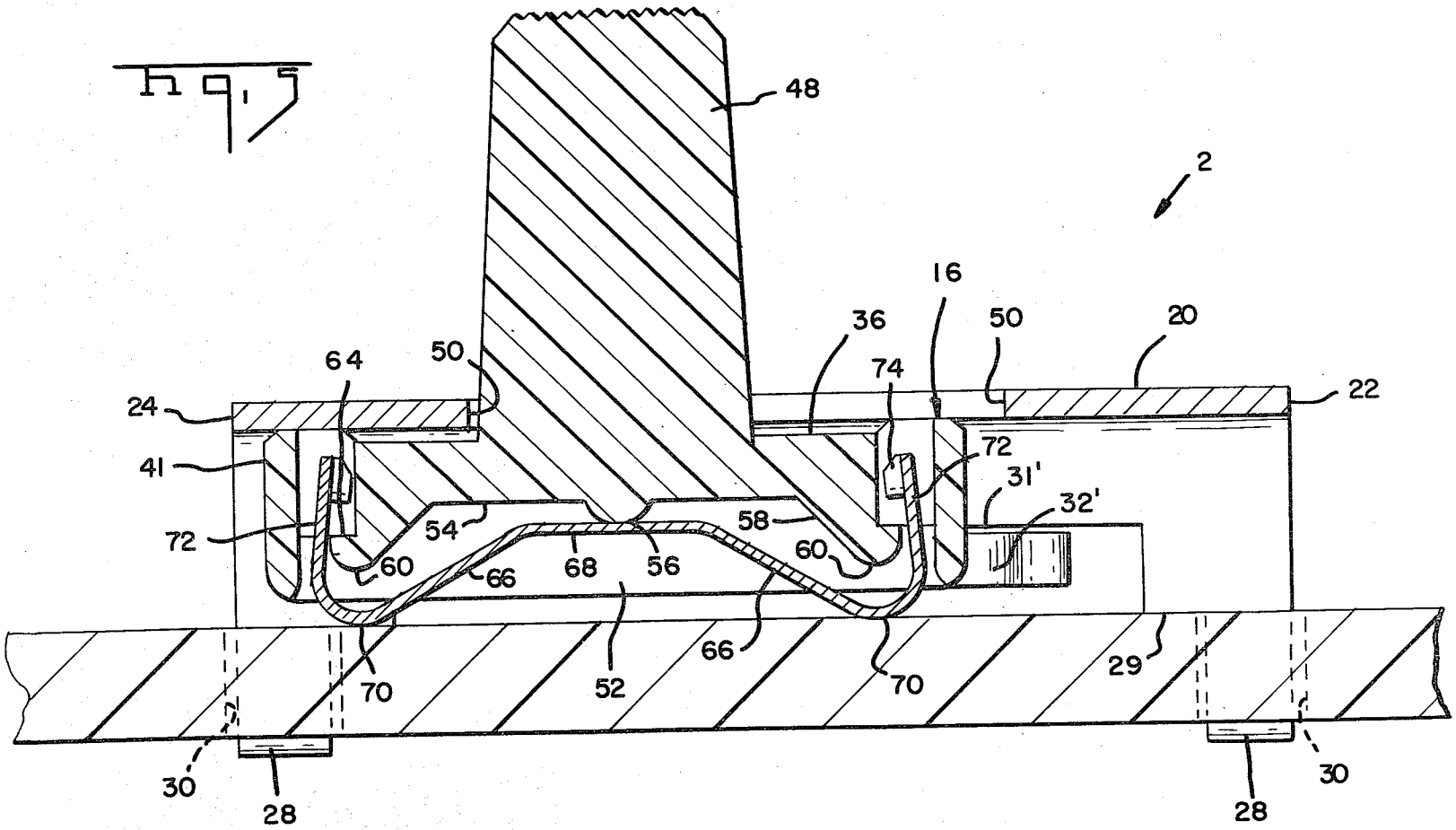
Figure 9:
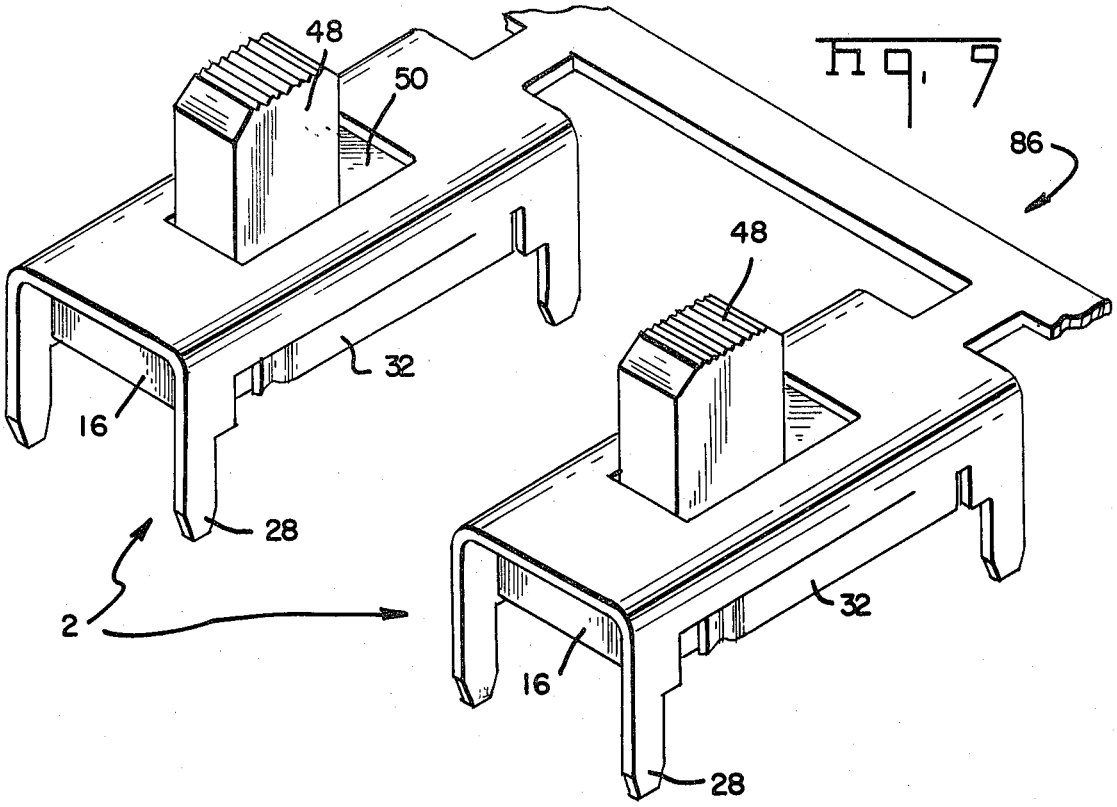

Each of the switch contacts 18 is of stamped and formed spring material, such as a hardened brass or phosphor bronze, and comprises two spaced-apart generally U-shaped contact sections, the adjacent arms 66 of which are connected by a connecting strap section 68. The reversely formed portion 70 of each contact section constitutes a contact portion which bears against the surface of the circuit board and the remote arms 72 have ears 74 on their free ends. The contact members are assembled to the slide members by merely moving them into the cavities 52, 52' in the slide member until the ears 74 lodge against the shoulders 64 of the openings 62. The central portions of the connecting straps 68 will bear against the reaction surfaces 56 and the contact portions 70 will be disposed outwardly from the surface 38 of the slide member. As shown in FIG. 5, when the switch is assembled to the circuit board, the contact members will be in a flexed condition thereby providing contact force at the electrical interfaces with the terminal pads on the circuit board. It will be noted from FIG. 5 that the surface 38 is normally spaced from the surface 4 of the circuit board and it is therefore possible that the slide member can be pushed downwardly from the position shown in FIG. 5 when the switch condition is changed. The spring properties of the contact member should be selected such that the spring contact members will not be overstressed if the slide member is pushed downwardly during changing the condition of the switch.

As shown in FIGS. 6–8, the contact members and the housings are produced as continuous strips, the individual housings being produced as a strip 76 comprising a carrier strip 78 with each housing connected as its end 24 with the carrier strip by a connecting section 80. The contact members 18 are connected to each other by means of connecting sections 84 which extend between the strap portions 68 of adjacent contact members. The contact members can therefore be assembled to the slide members by means of automatic machinery by shearing individual contact members from the strip and inserting them into the slide members. Similarly, the slide members can be produced in strip form and assembled to the housings while the housings are in the form of a continuous strip to produce a continuous strip 86, FIG. 7, of assembled switches which can be wound on a reel. The strip 86 of switches can then be assembled to circuit boards by means of automatic or semi-automatic insertion machinery of the type having a severing means for severing the leading switch from the strip and inserting it into a circuit board.

A variety of types of switches can be made in accordance with the invention. A number of contact members greater than two can be provided, if desired, or a single contact member only may be required under some circumstances. The housing and the slide member can be lengthened beyond the dimensions shown to provide multiple detent stations for switching to more than two pairs of terminal pads 10, 10' and 12, 12'. It is also possible to produce a switch having two or more contact members 18 integral with each other by leaving in the connecting section 84 on the two contact members. The central opening extending into the underside of the surface 38 extends to this surface of the connecting section 84 would then be disposed in the lower portion of the opening 49.

Figure 10:
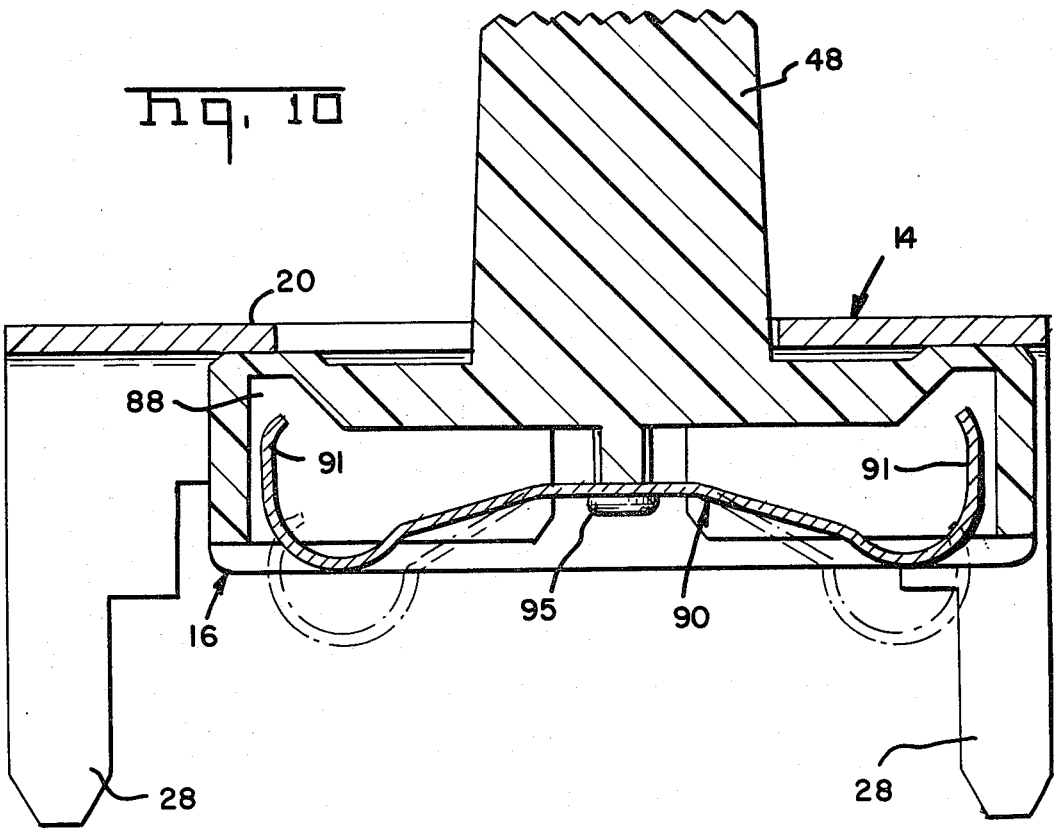
Figure 11:
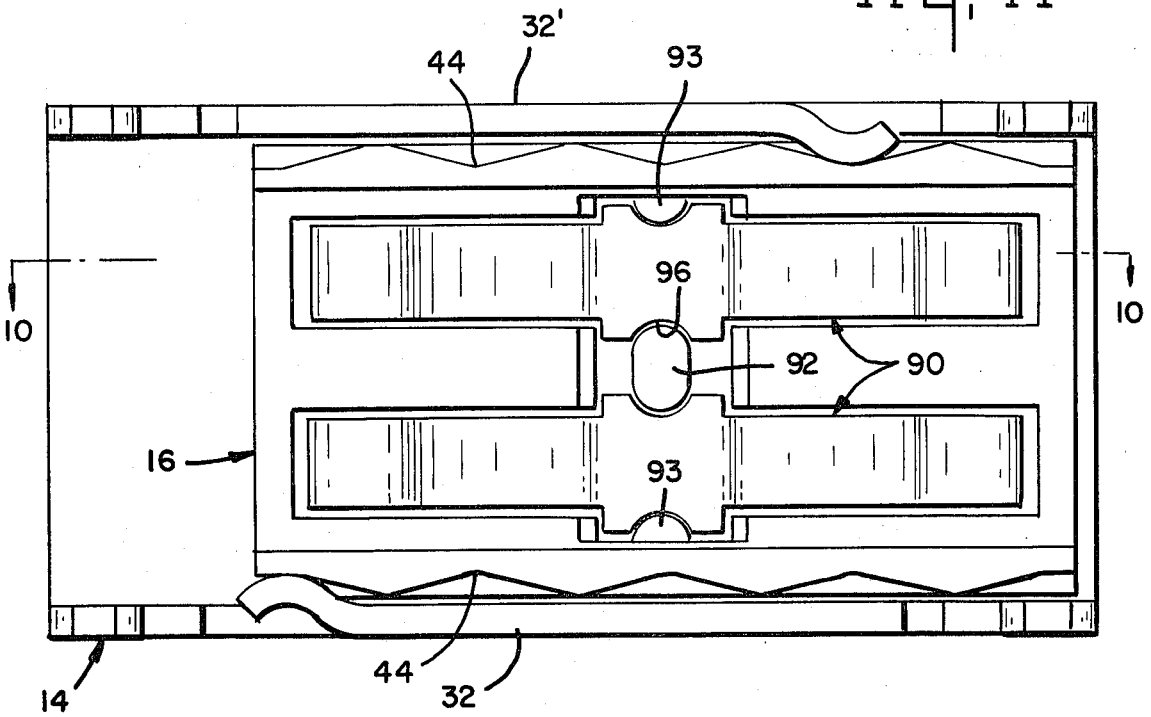
Figure 12:
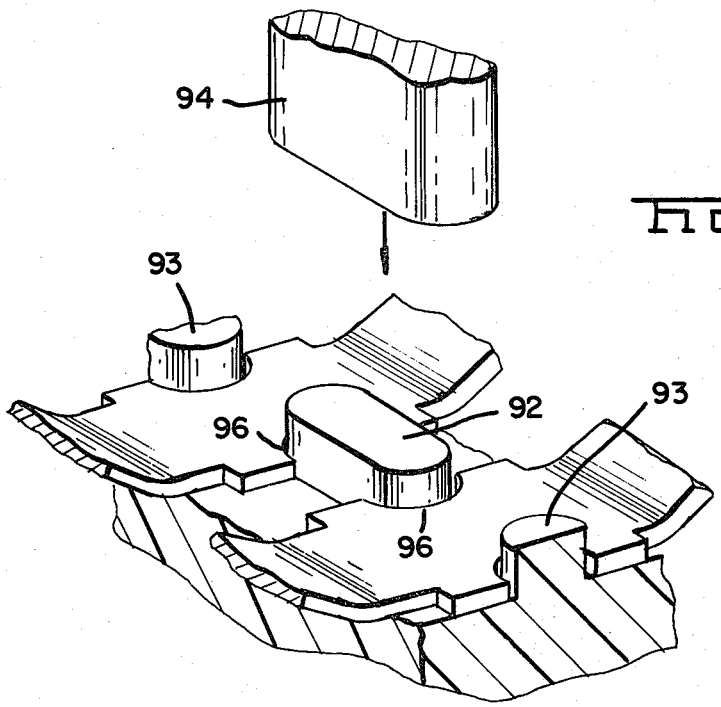

FIGS. 10 and 11 show an alternative embodiment in which the contact members 90 have outer arms 91 which are received in recesses 88 in the slide member but are not latched to shoulders in these recesses. Integral boss means 92, 93 are provided in the slide member adjacent to the terminal receiving cavities, the boss members 93 being half-round. These boss members have sidewall portions which extend into complementary notches 96 in the contact members, as shown in FIGS. 11 and 12. The contact members are secured in position by heat staking these boss members by means of a suitable heat staking tool 94, as shown in FIG. 12, ao that the material of the boss members flows over surface portions of the contact members, as indicated at 95 in FIG. 10. It will be apparent that the contact members 90 are thus positively secured to the slide member by the heat staked bosses 95 rather than being retained by the interengaging shoulder and ear means 74, 64 of the previously described embodiment.

We claim:

1. A slide switch which is intended for mounting on a circuit board having first and second terminal pads on one surface thereof, said switch comprising:

a switch housing and a slide member, said housing being generally channel-shaped and having a web, sidewalls and means for mounting said housing on said one surface with edge portions of said sidewalls against said one surface and with said web spaced from said one surface, said slide member comprising a block of insulating material slideably contained between said sidewalls for movement parallel to the axis of said housing, said slide member having inwardly and outwardly directed major surfaces, said inwardly directed major surface being opposed to the internal surface of said web, said outwardly directed major surface facing outwardly from said housing, a contact member mounted on said outwardly directed major surface, said contact member having spaced-apart contact portions and a connecting strip extending between said contact portions, said contact portions being spaced outwardly from said outwardly directed major surface and located proximate to the ends of said slide member, spring means effective between said contact member and said outwardly directed major surface, said spring means serving to bias said contact portions outwardly from said outwardly directed major surface while permitting movement of said contact portions towards said outwardly directed major surface and interengaging means effective between said housing and said slide member serving to retain said slide member in said housing, said interengaging means permitting sliding movmement of said slide member relative to said housing whereby, upon mounting said switch on said circuit board in covering relationship to said terminal pads, said spring means will bias said contact portions against said one surface of said circuit board, and said slide member can be moved between first and second positions in which said contact portions are against both of said terminal pads and are not against both of said terminal pads respectively.

2. A slide switch as set forth in claim 1, said spring means comprising said connecting strap, said connecting strap bearing against a reaction portion of said outwardly directed surface.

3. A slide switch as set forth in claim 1, said contact member comprising a pair of spaced-apart U-shaped portions, said U-shaped portions having proximate arms and remote arms which are proximate to, and remote from each other respectively, said connecting strap extending between said proximate arms.

4. A slide switch as set forth in claim 3, said remote arms having free ends which extend towards said outwardly directed major surface.

5. A continuous strip of slide switches of a type which are intended for mounting on a circuit board, said strip comprising:

a continuous sheet metal carrier strip having said slide switches integral therewith and extending laterally therefrom at spaced-apart intervals, each of said switches comprising a switch housing and a slide member, said housing comprising a stamped and formed sheet metal channel-shaped member having a web and sidewalls, one end of said web being adjacent to said carrier strip and being connected to said carrier strip by an integral connecting section, each of said switch housings having integral mounting means extending therefrom for mounting said switches on circuit boards, said slide member comprising a block of insulating material slidably contained between said sidewalls for movement parallel to the axis of said housing, said slide member having side surfaces which are opposed to the internal surfaces of said sidewalls and having an outwardly directed major surface which extends between said side surfaces, contact means on said outwardly directed major surface for engagement with said terminal pads, retaining means for retaining said slide member in assembled relationship to said housing, said retaining means comprising inwardly extending portions of said sidewalls and retaining shoulder portions of said slide member, said inwardly extending portions of said sidewalls extending past said retaining shoulder portions of said slide member, whereby, said switches can be serially assembled to circuit boards by feeding said strip to an insertion apparatus, severing the leading switch on said strip from said carrier strip, and moving said leading switch towards, and into assembled relationship with, said circuit board.

6. A slide switch which is intended for mounting on a circuit board having first and second terminal pads thereon, said switch comprising:

a switch housing and a slide member, said switch housing comprising a stamped and formed sheet metal channel-shaped member having a web and sidewalls, said slide member comprising a block of insulating material slidably contained between said sidewalls for movement parallel to the axis of said housing, said slide member having side surfaces which are opposed to the internal surfaces of said sidewalls and having an outwardly directed major surface which extends between said side surfaces, contact means on said outwardly directed major surface for engagement with said terminal pads, retaining means for retaining said slide member in assembled relationship to said housing, said retaining means comprising inwardly extending portions of said sidewalls and retaining shoulder portions on said slide member, said inwardly extending portions of said sidewalls extending past said retaining shoulder portions of said slide member, and detent means for maintaining said slide member in one of at least two selective positions relative to said housing, said detent means comprising resilient means struck from said sidewalls and spaced apart recess means in said side surfaces of said slide member, said resilient means extending into said recess means when said slide member is in one of selective positions whereby, said switch can be mounted on said circuit board in covering relationship to said terminal pads, and said pads can be electrically connected and disconnected upon movement of said slide member between said selective positions.

7. A slide switch as set forth in claim 6, said retaining means and said detent means comprising a spring arm on each of said sidewalls, each spring arm being struck from its respective sidewall and extending beside, and convergently towards, the axis of said housing, each spring arm having a free end which is received in said recess means in said side surfaces, and each spring arm having edge portions thereof extending past said retaining shoulder portions of said side surfaces.

8. A slide switch as set forth in claim 7, said retaining shoulder portions on each of said side surfaces comprising continuous shoulder surfaces extending parallel to said axis of said housing.

9. A slide switch as set forth in claim 8, said spaced-apart recess means being between said shoulder surfaces and said outwardly directed major surface.

10. A slide switch as set forth in claim 6, said housing being integral with a continuous carrier strip having a plurality of slide switches which are identical to said slide switch extending therefrom at spaced-apart intervals.

11. A slide switch as set forth in claim 6, said housing having integral mounting means extending therefrom for mounting said switch on said circuit board.

* * * * *